United States Patent [19]

Bush et al.

[11] 4,202,378

[45] May 13, 1980

[54] REBAR SAFETY CAP

[76] Inventors: Lyman F. Bush, 1217-122nd St. Ct. E., Tacoma, Wash. 98445; Dennis R. Weaver, 4614 Ray Nash Dr. N.W., Gig Harbor, Wash. 98335

[21] Appl. No.: 878,437

[22] Filed: Feb. 16, 1978

Related U.S. Application Data

[63] Continuation-in-part of Ser. No. 695,001, Jun. 11, 1976, abandoned.

[51] Int. Cl.[2] ..... B65D 59/06

[52] U.S. Cl. ..... 138/96 R; 138/96 T

[58] Field of Search ..... 138/96 R, 96 T, 89

[56] References Cited

U.S. PATENT DOCUMENTS

| | | | |
|---|---|---|---|
| 1,718,161 | 6/1929 | Lutch | 138/96 R |
| 2,551,834 | 5/1951 | Ferguson | 138/96 T |
| 2,873,765 | 2/1959 | Gregory | 138/96 R |
| 3,104,681 | 9/1963 | Gray, Jr. | 138/96 R |
| 3,160,175 | 12/1964 | Laemmle | 138/96 R |
| 3,485,271 | 12/1969 | Halsey | 138/96 T |

*Primary Examiner*—Willis Little

*Attorney, Agent, or Firm*—Eugene D. Farley

[57] ABSTRACT

A safety cap for rebar (concrete reinforcing steel) projecting from unfinished construction work protects workmen and passersby from injury resulting from striking the projections. The cap comprises an integral, hollow cylindrical body of resiliently deformable plastic material closed at one end and open at the other. At its closed end the body mounts a radial impact head of enlarged diameter. The open end of the body is split longitudinally to provide an expandable gripping lip. The hollow bore is stepped to provide shoulders accommodating rebar ends of varying diameter.

1 Claim, 8 Drawing Figures

REBAR SAFETY CAP

BACKGROUND AND SUMMARY OF THE INVENTION

This application is a continuation-in-part of the patent application of Bush et al, Ser. No. 695,001, filed June 11, 1976, now abandoned.

This invention pertains to a safety cap for placement over the projecting ends of rebar.

Particularly during the construction of buildings, there occur situations in which the ends of rebar extend vertically, horizonally or at an angle from structures in which they are contained. Such ends are sharp, and present a distinct hazard to workmen and passersby who inadvertently stumble against them, and as a result are bruised, abraded, or even stabbed by the projecting sharp ends.

The prior art illustrates the application of caps to objects other than rebar for various purposes. Thus U.S. Pat. Nos. 2,365,888; 2,632,479; 2,873,763; 3,065,767; 3,104,681; 3,847,183; 3,160,175 and 3,174,588 illustrate the application and use of various rod and pipe caps. However, none of the prior art caps have the construction, attributes and advantages which characterize the rebar safety caps of our invention, the objects of which are as follows:

It is the primary object of the present invention to provide a safety cap for placement over projecting rebar ends, thereby protecting from injury passersby who accidently strike against them.

Other important objects of the invention are the provision of a safety cap for the projecting ends of rebar which grips the rebar securely, which may be applied easily, which after use may be removed for reuse, which accomodates various sizes of rebar, which may be left on the projecting ends permanently if desired; and which may be provided in a variety of bright colors for easy visibility.

The foregoing and other objects of the invention are accomplished by the provision of a safety cap comprising on integral, hollow, cylindrical body of resiliently deformable plastic material closed at one end and open at the other. The cap has a hollow body characterized by a stepped bore of progressively smaller internal diameter in the direction of the closed end, thereby providing at longitudinally spaced intervals shoulders for abutment by rebar ends of varying diameter.

The closed end of the body includes a radially extending impact head, which preferably is flat and flexible. The open end of the body is of restricted diameter, forming a lip. Also, it is slit longitudinally at spaced radial intervals to provide an expandable gripping segment. The interior of the hollow body is provided with a plurality of inwardly extending projections dimensioned to engage frictionally the side walls of the rebar, thereby in use retaining the cap thereon.

DESCRIPTION OF THE PREFERRED EMBODIMENT

The invention is described herein with particular reference to the drawings wherein.

Figure 7:
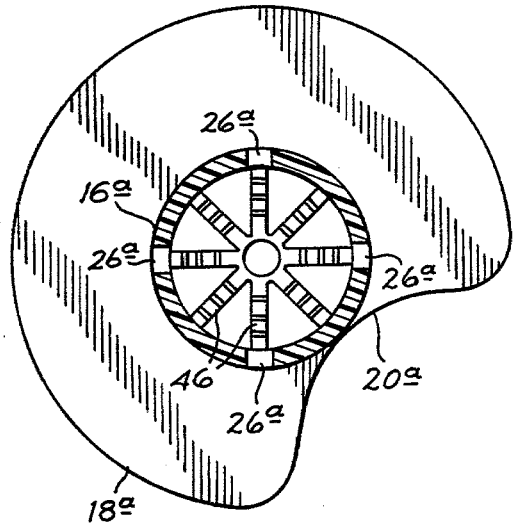
Figure 6:
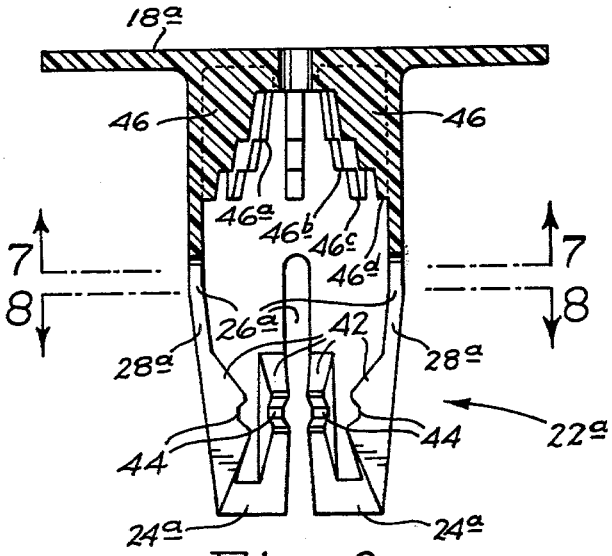
FIG. 6 is a longitudinal sectional view of the cap of FIG. 5 taken along line 6—6 thereof.
Figure 8:
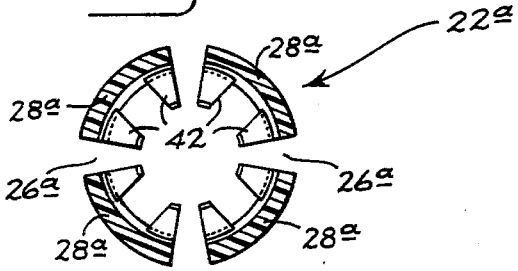

FIGS. 7 and 8 are transverse sectional views taken along lines 7—7 and 8—8 respectively of FIG. 6.

Figure 1:
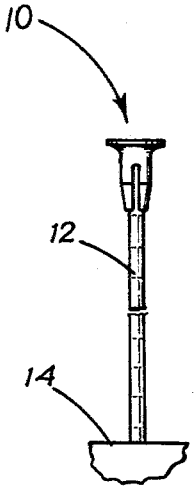
FIG. 1 is a fragmentary schematic view illustrating the hereindescribed safety cap as applied to the projecting end of a length of rebar.

As shown in FIG. 1, the safety cap 10 of our invention may be applied to the projecting end of a length of rebar 12 which extends outwardly from concrete structural element 14. Such projections are commonplace on construction sites. They often are sharp and present a distinct hazard to workmen and passersby who inadvertently strike or stumble against them.

Figure 3:
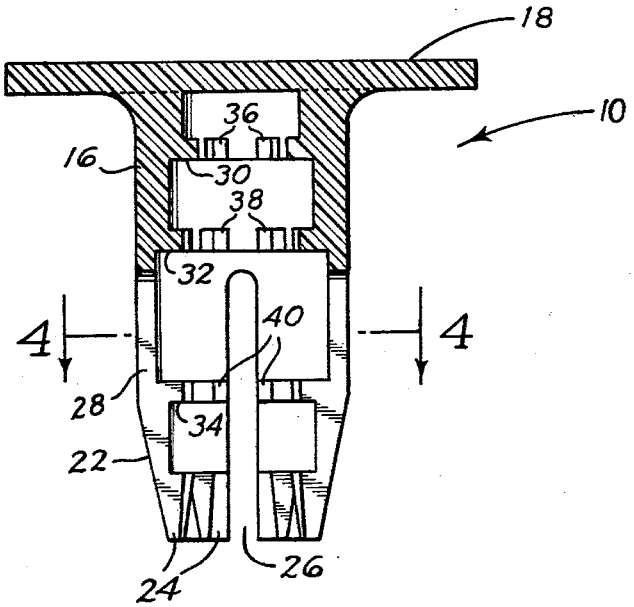
FIG. 3 is a longitudinal section of the safety cap taken along line 3—3 of FIG. 2.
Figure 4:
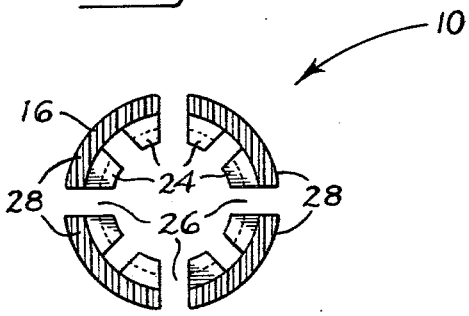
FIG. 4 is a transverse sectional view of the safety cap taken along line 4—4 of FIG. 3.
Figure 5:
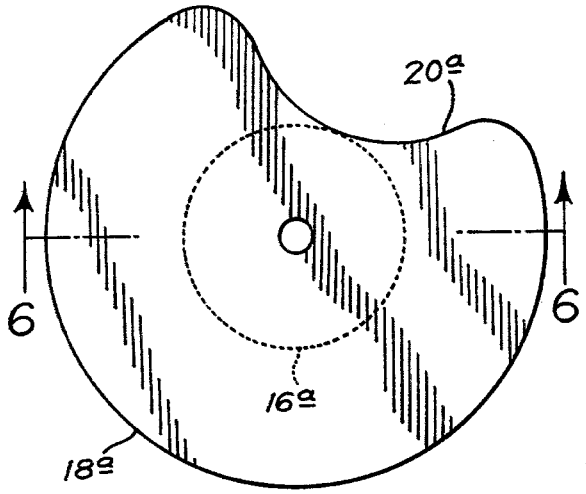
FIG. 5 is a top plan view illustrating the hereindescribed safety cap in an alternate embodiment.

As shown particularly in FIG. 3, safety cap 10 comprises an integral, hollow cylindrical body 16 of resiliently deformable plastic material. Such material is preferably brightly colored so that the cap may be seen readily when it is mounted on the projection.

Hollow cylindrical body 16 is closed at one end with an overhanging impact head 18. This preferably is flat, generally circular in outline, and relatively thin and flexible. In effect it increases the effective diameter of the projecting end and presents a resilient, flexible, contact surface which cushions the impact of a person striking against the projection.

Figure 2:
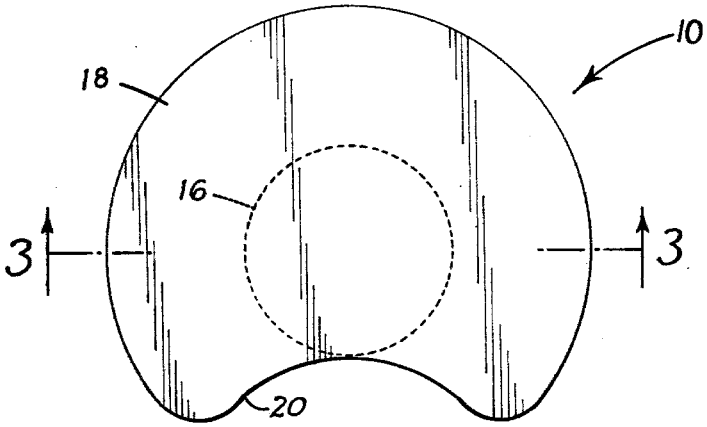
FIG. 2 is a top plan view of the safety cap.

Preferably, the impact head has a notch 20, as shown in FIG. 2. This is dimensioned to receive the shank of an adjacent rebar end in the event that the cap is to be applied in a cluster of such ends, as commonly is present at construction sites.

The exterior surface 22 of the open end of the hollow cylindrical body preferably is inwardly tapered. Also, it is provided with a lip 24 of reduced diameter for gripping the side walls of the projecting end to which the cap is applied.

The open end of the body is further provided with a plurality of circumferentially spaced, longitudinally extending slots 26. In the illustrated form of the invention there are four such slots spaced at 90° from each other. These define fingers 28 which resiliently grip the projecting end, further retaining the cap thereon.

The hollow bore of the cap is characterized by a stepped configuration, being of progressively decreasing internal diameter inwardly of the open end. There thus are provided at longitudinally spaced intervals along the bore a plurality of abutment shoulders 30, 32, 34 of progressively decreasing extent. In a typical instance, such shoulders may define internal diameter dimensions of $\frac{3}{8}$ inch, $\frac{1}{2}$ inch and $\frac{5}{8}$ inch, respectively thereby making the cap universally applicable to projecting rebar of corresponding diameter.

Further to assist in gripping the projecting end and in mounting the cap securely thereon, there are provided a plurality of inwardly extending projections 36, 38, 40. These preferably are provided in rings at spaced longitudinal intervals and are associated respectively with shoulders 30, 32, 34.

The form of the invention illustrated in FIGS. 5–8 inclusive is characterized by being particularly efficient in gripping rebar ends of various diameters securely, and also by being well adapted to mass production at low cost by present-day plastic molding techniques.

It comprises an integral, hollow, cylindrical plastic body 16*a*. The body 16*a* is closed at one end with an overhanging impact head 18*a*. Impact head 18*a* has a notch 20*a* dimensioned to receive the shank of an adjacent rebar.

The lower end 22*a* of the hollow cylindrical body is inwardly and downwardly tapered. It is provided with a lip 24*a* of reduced diameter for gripping the side walls of the rebar end to which the cap is applied.

The open end of the body further is provided with a plurality of circumferentially spaced, longitudinally extending slots 26*a*. These define fingers 28*a* which grip resiliently the rebar end, and further retain the cap thereon.

To assist further in gripping the rebar end and to mount the cap securely thereon, there are provided a plurality of longitudinal, inwardly extending ribs 42. These are disposed one on each side of slot 26*a*. Their ends are tapered, as viewed particularly in FIG. 6, for ease in mounting the cap on the rebar and demounting it therefrom. Their central portions are provided with notches 44 which, with the tapered ends of the ribs, provide inwardly extending projections for contacting the rebar.

As in the case of the previously described embodiment, the hollow bore of the cap is characterized at its upper end by a stepped configuration of progressively decreasing internal diameter.

In this embodiment the stepped configuration is achieved by the provision of a second plurality of longitudinally extending, circumferentially spaced, stepped ribs 46. The rib steps 46*a*, 46*b*, 46*c*, and 46*d* provide, together with the undersurface of cap 18*a*, a plurality of progressively smaller abutment surfaces. This makes the cap universally applicable to projecting rebar ends of corresponding diameters.

OPERATION

When the cap 10 is placed over the sharp projecting end of a length of rebar 12, the rebar end will first wedge open the slotted end of the cap, and enter the hollow body.

Depending upon its external diameter, it then will seat itself against the inner surface of impact head 18, or one of abutment shoulders 30, 32, 34 (FIGS. 1–4), or one of abutment shoulders 46*a*, 46*b*, 46*c* or 46*d* (FIGS. 5–8).

In place, it will be retained releasably by frictional engagement not only with stretched lip 24, but also with the engaged ones of inwardly extending projections 36, 38, 40 (FIGS. 1–4) or ribs 42 (FIGS. 5–8). It also is retained by seating tightly into the stepped ribs 46.

The cap thus will be secured in place for as long as the hazard exists. Being brightly colored, it warns workmen and passersby of the presence of the projecting ends of the rebar. However, if inadvertent contact with such projecting ends should occur, the workmen or passerby is protected from contact with sharp edges. Instead, he strikes against the yielding impact head 18 which minimizes the injury, if any such injury occurs.

When the hazard no longer exists, the caps easily may be removed and applied to similar uses in other situations.

Having thus described our invention in preferred embodiment, we claim:

1. A safety cap for use on the projecting ends of rebar comprising:

(a) an integrated, hollow cylindrical body of resiliently deformable plastic material, closed at one end and open at the other, (b) the open end of the body being slotted longitudinally at circumferentially spaced intervals to provide a plurality of longitudinally elongated resiliently expandable fingers, and (c) gripping ribs projecting radially inward from the fingers intermediate the ends of said fingers and defining a rebar entrance opening of reduced diameter with respect to the inwardly adjacent bore of the hollow body, the inner surfaces of the ribs diverging angularly outward to the outer ends of the fingers for guiding rebar into said entrance opening, (d) a plurality of longitudinally extending, circumferentially spaced, abutment ribs extending radially inwardly within and adjacent the closed end of the hollow body, the ribs being tapered and notched to provide longitudinally spaced rebar abutment shoulders of progressively decreasing diameter toward the closed end of the body, for abutting the rebar both radially and axially and (e) a flat overhanging impact head of substantial extent and generally circular contour extending radially outward from the closed end of the body.

* * * * *